United States Patent [19]

Fekete

[11] 4,094,701

[45] June 13, 1978

[54] METHOD FOR CLEANING TIN SURFACES

[75] Inventor: Douglas D. Fekete, Warren, Mich.

[73] Assignee: Oxy Metal Industries Corporation, Warren, Mich.

[21] Appl. No.: 668,011

[22] Filed: Mar. 18, 1976

[51] Int. Cl.[2] ..... B08B 3/08

[52] U.S. Cl. ..... 134/2; 134/40; 252/84; 252/85

[58] Field of Search ..... 134/2, 29, 40; 252/84, 252/85, 156

[56] References Cited

U.S. PATENT DOCUMENTS

| | | | |
|---|---|---|---|
| 1,628,163 | 5/1927 | Lillejord | 252/84 |
| 2,215,814 | 9/1940 | Hall | 252/85 X |
| 2,836,566 | 5/1958 | Duncan | 134/2 X |
| 3,888,783 | 6/1975 | Rodzewich | 134/2 X |

FOREIGN PATENT DOCUMENTS

| | | | |
|---|---|---|---|
| 28,863 | 2/1931 | Australia | 252/84 |
| 19,292 of | 1907 | United Kingdom | 252/85 |
| 1,293,440 | 10/1972 | United Kingdom | 252/84 |

*Primary Examiner*—S. Leon Bashore
*Assistant Examiner*—Marc L. Caroff
*Attorney, Agent, or Firm*—Arthur E. Kluegel; Bertram F. Claeboe; Richard P. Mueller

[57] ABSTRACT

An aqueous alkaline solution containing an organic tannin is used to clean a tin surface. The composition is particularly useful for cleaning tin surfaces because the presence of the tannin inhibits etching of the tin surface which normally occurs under alkaline conditions.

5 Claims, No Drawings

METHOD FOR CLEANING TIN SURFACES

BACKGROUND OF THE INVENTION

This invention relates to the art of cleaning a substrate surface. In particular, it relates to the art of cleaning, without at the same time etching, a tin surface. Even more particularly, it relates to the art of cleaning tin-plated surfaces, such as tin cans which have been previously subjected to cold forming operations during which organic lubricants are applied to the tin surface as drawing aids.

Cleaning is essential as a preliminary to many surface finishing operations. Cleaning is normally required, for example, prior to corrosion preventive treatments and prior to the application of organic finishes to the surface. Cleaning is especially important in the case of metal surfaces to which organic materials have been recently applied as an aid to cold forming, which materials must then be removed in order to obtain a surface suitably receptive to an organic finish.

One example of the need for such a cleaner is in the manufacture of two piece, tin-plate, drawn and ironed cans. In the manufacture of tin-plate cans, circular blanks of tin-plated steel are first cupped and then passed through several drawing dies to iron the cup in order to form a unitary side wall and can bottom structure. These forming operations are assisted and the dies and metallic surface protected by the application of lubricants to the tin-plate surface prior to or during the forming operation. Since it is desired to have a clean surface in order to assure adhesion of a subsequently applied sanitary lacquer and/or decorative varnish, the cleaning step after forming is critical to a successful manufacturing process.

Conventional cleaners for metal surfaces are described in the *Metal Finishing Guidebook and Directory,* pages 195–218, (1974). Cleaners useful for tin-plate surfaces are described, for example, by R. J. Kerr in *J. Soc. Chem. Inc.* (London) 65:101 (1946). The Kerr article refers to alkaline aqueous composition for tin-plate cleaning containing sodium dichromate, trisodium phosphate, and sodium hydroxide.

Difficulties with tin surface cleaners have centered around an attempt to obtain a cleaner which will provide a waterbreak-free surface without unduly etching the surface. Etching results from chemical attack of the tin surface which roughens and dulls the surface. Alkaline cleaners have been found most suitable for producing the desired clean surface, but have been less than desirable because of their tendency to etch the surface. Where a smooth, shiny surface is desired such as in the case of a beverage can, etching is clearly undesirable. Furthermore, etching removes a portion of the corrosion protective tin from the surface thereby degrading the anti-corrosion qualities of the surface. It has previously been discovered that the presence of hexavalent chromium compounds in the cleaning solution will help to inhibit etching of the tin surface under the alkaline conditions employed. The use of chromium compounds is undesirable however because they are environmentally objectionable in plant effluents and because they are highly toxic and therefore of concern when used in connection with the processing of food containers such as beverage cans.

It would therefore be desirable to have available an alkaline aqueous cleaning composition which could be used to clean substrate surfaces, but which when employed to clean a tin surface will not cause undue etching.

SUMMARY OF THE INVENTION

It has now been discovered that the inclusion of an organic tannin component in an aqueous alkaline cleaning composition will inhibit etching of a tin surface by the alkaline cleaner. Thus, the cleaner of the present invention has the advantage that it may be used to clean a variety of surfaces either simultaneously or sequentially without recessitating resort to a special separate cleaner when it is desired to clean a tin surface.

DETAILED DESCRIPTION OF THE INVENTION

The cleaner of the present invention is an alkaline aqueous composition. One or more surfactants will normally be employed to further the cleaning ability of the cleaner and an organic tannin component is included to inhibit etching of tin surfaces.

The specific alkaline component employed in the cleaning composition is not critical. Any compounds normally employed to provide alkalinity in an aqueous cleaner are suitable. Examples include the alkali metal borates, carbonates, phosphates, hydroxides, oxides and silicates. These components should be present in the solution in concentrations sufficient to provide a cleaner of the desired pH.

The chemistry of organic tannins is not completely understood. The organic tannins include natural extracts and synthetic materials. Extracts include a large group of water soluble, complex organic compounds widely distributed throughout the vegetable kingdom. All have the common property of precipitating gelatin from solutions and of combining with collagen and other protein matter in hides to form leather. All natural tannin extracts examined contain mixtures of polyphenolic substances and normally have associated with them certain sugars. (It is not known whether these sugars are an integral part of the structure.) For a discussion of tannins, see *Encyclopedia of Chemical Technology,* 2nd edition, Kirk-Othmer; XII (1967) pages 303–341 and *The Chemistry and Technology of Leather,* Reinhold Publishing Corporation, New York, pages 98–220 (1958).

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often extracts are mixed and contain both hydrolyzable and condensed forms. No two tannin extracts are exactly alike. Principal sources of tannin extracts include bark such as wattle, mangrove, oak, eucalyptus, hemlock, pine larch, and willow; woods such as quebracho, chestnut, oak and urunday, cutch and turkish; fruits such as myrobalans, valonia, divi-divi, tera, and algarrobilla; leaves such as sumac and gambier; and roots such as canaigre and palmetto.

The term "organic tannins" is employed to distinguish natural extract and synthetic organic tannins such as those listed in the previous paragraph from the mineral tanning materials such as those containing chromium, zirconium and the like. Experimental work has shown that hydrolyzable, condensed, and mixed varieties of organic tannins may all be suitably used in the present invention.

The concentration of the organic tannin in the cleaner must be of at least such minimum amount as to inhibit etching of a tin surface. The precise minimum concentration required will depend to some extent upon the temperature and pH of the particular cleaner employed. Normally, a concentration of at least 0.01% or greater will be required. Concentrations as high as the solubility limit of the solution may be employed, but should not be required.

Examples of tannins which may be employed in the present invention are listed in Table I. The preferred tannins are myrobalan, wattle, tannic acid, quebracho, and chestnut extract.

An added advantage of the presence of tannin is that corrosion resistance as measured by ASTM Salt Spray and Humidity tests is improved over that obtained with the same cleaner without the tannin.

The temperature and pH of the cleaning solution are interrelated. Increased temperatures as well as increased pH values tend to improve the cleaning rate of the cleaner. Whereas a temperature of 125° F might be suitable at a pH value of 12.5, a temperature of 150° F may be required to obtain the same results at a pH of 10.3. In general, the pH of the cleaner should be at least 9.0 and is preferably between 10 and 13. Most preferably the pH of the cleaner is between 10 and 10.5. The presence of the organic tannin inhibits etch even at high pH values, but it has been found that the higher pH values tend to gradually inactivate the tannin necessitating more frequent additives. Accordingly, the lower pH values in the alkaline range are preferred because they favor stability of the tannin. Thus, temperatures of 140° F and upwards will normally be employed when the cleaner is adjusted to the preferred pH range.

The temperature employed will normally be a function of the selected pH value of the cleaner. Temperatures of from 100° to 180° F may be suitable with temperatures in excess of 140° F being desirable for the preferred pH range.

The presence of one or more surfactant compounds in an alkaline aqueous cleaner solution often acts as an aid to the cleaning power of the solution. The presence or absence of surfactants has been found to have no noticeable effect as

TABLE I

| TANNINS NAME | SUPPLIER |
|---|---|
| Tannic Acid | Merck and Company, Inc. |
| Tannic Acid (NFXII) | S.B. Penick and Company |
| Tannic Acid (Tech. 3C) | The Harshaw Chemical Co. |
| Tannic Acid (Tech. XXX) | The Harshaw Chemical Co. |
| Tannic Acid (Tech. 7c) | The Harshaw Chemical Co. |
| Chestnut Extract | The Mead Corporation |
| Spray Dried Chestnut | Arthur C. Trask Corp. |
| Bisulfited Quebracho Extract | Arthur C. Trask Corp. |
| Non-Bisulfited Quebracho Extract | Arthur C. Trask Corp. |
| Wattle Extract | Arthur C. Trask Corp. |
| Cutch Extract | Arthur C. Trask Corp. |
| Myrobalan Extract | Arthur C. Trask Corp. |

inhibiting or promoting the etching of a tin surface by the cleaner. If desired, any surfactant known to be useful for alkaline aqueous cleaners may be employed in the cleaner of the present invention. Specific examples include Triton N101 manufactured by Rohm & Haas Co. which is a nonyl phenoxy polyethoxy ethonol; Tergitol 15-S-9 manufactured by Union Carbide Corp. which is a polyethylene glycol ether of a linear alcohol; Pluronic 31-R-1 manufactured by BASF Wyandotte Corp. which is a condensate of propylene oxide, ethylene oxide and ethylene glycol; and Tergitol 08 manufactured by Union Carbide Corp. which is a sodium sulfate derivative of 2-ethyl,1-hexanol.

The cleaner of the invention is particularly suitable for cleaning tin-plate surfaces and also functions to satisfactorily clean the surfaces of other substrates and in particular other metal substrates such as steel and aluminum.

EXAMPLE 1

Drawn and ironed tin-plate can bodies were spray cleaned with an aqueous solution containing:

| Component | wt. % |
|---|---|
| $Na_2CO_3$ | 0.28 |
| NaOH | 0.35 |
| Tannin (Myrobalan) | 0.05 |
| Triton N101 | 0.05 |
| Pluronic 31-R-1 | 0.025 |

The pH value of the cleaner was 12.5 and the temperature was 125° F. The cans were waterbreak-free after 1.5 minutes, but exhibited no etch even after 3 minutes contact.

EXAMPLE 1A

Cleaning as in Example 1 at a temperature of 140° F resulted in unetched waterbreak-free cans after one minute.

EXAMPLE 1B

Cleaning as in Example 1 with a myrobalan content of 0.025% resulted in unetched waterbreak-free cans after one minute.

EXAMPLE 1C

The concentrations of Example 1 were doubled giving a pH value of 13.0. At 130° F unetched waterbreak-free tin cans were obtained after 1.5 minutes.

EXAMPLE 1D

Cleaning as in Example 1 with 0.025% Wattle substituted as the tannin resulted in unetched waterbreak-free tin cans after one minute.

EXAMPLE 1E

Cleaning as in Example 1A with 0.05% of Tergitol 08 substituted for the two surfactants resulted in unetched waterbreak-free tin cans after 2 minutes. Many other surfactants were substituted with similar results.

EXAMPLE 1F

To simulate a used cleaning bath, 0.01% of Quakerol 539, a water emulsitiable lubricant commonly employed in can forming, was added to the cleaner of Example 1. Unetched waterbreak-free tin cans were obtained at 140° F after 1.5 minutes.

COMPARATIVE EXAMPLE 1

Example 1 was repeated, but the tannin was omitted from the cleaner. After only 1 minute at 125° F the tin surface had been visibly attacked and was frosted in appearance.

EXAMPLE 2

An aqueous cleaner was prepared to contain:

| Component | wt. % |
|---|---|
| $Na_2HPO_4$ | 0.26 |
| $Na_3PO_4$ | 0.26 |
| NaOH | 0.37 |
| Tannin (Myrobalan) | 0.026 |
| Tergitol 15-S-9 | 0.016 |
| Triton N101 | 0.010 |
| Pluronic 31-R-1 | 0.026 |

At a pH of 12.4 and a temperature of 125° F, unetched waterbreak-free tin cans were obtained after 2 minute spray.

EXAMPLE 3

An aqueous cleaner was prepared to contain:

| Component | wt. % |
|---|---|
| $Na_2CO_3$ | 0.26 |
| NaOH | 0.26 |
| Tannin (Tannic Acid) | 0.026 |
| Tergitol 15-S-9 | 0.095 |
| Triton N101 | 0.063 |

At a pH of 11.8, unetched, waterbreak-free tin cans were obtained after 1 minute spray at temperatures of 130° to 150° F.

EXAMPLE 3A

Example 3 was repeated with 0.026% Quebracho substitute for the tannin. At a pH of 12.1, unetched waterbreak-free tin cans were obtained after 1 minute spray at temperatures of 130° to 140° F.

EXAMPLE 4

An aqueous cleaner was prepared to contain:

| Component | wt. % |
|---|---|
| $Na_2CO_3$ | 0.26 |
| NaOH | 0.37 |
| Tannin (Chestnut) | 0.05 |
| Triton N101 | 0.05 |
| Pluronic 31-R-1 | 0.026 |

At a pH of 12.5, unetched, waterbreak-free tin cans were obtained at 130° F after 1.5 minutes. No etching was observed even after 3 minutes.

EXAMPLE 5

An aqueous cleaner was prepared to contain:

| Component | wt. % |
|---|---|
| Tannin (Wattle) | 0.033 |
| Triton N101 | 0.066 |
| Pluronic 31-R-1 | 0.033 |
| Potassium Phosphate | to pH 10.3 |

At a temperature of 150° F, unetched waterbreak-free tin cans were obtained after 1 minute.

What is claimed is:

1. A process for cleaning a tin surface without substantial etching thereof comprising contacting the surface with an aqueous alkaline solution having a pH value of at least 9.0 and containing an organic tannin in an amount sufficient to inhibit etching of the surface.

2. The process of claim 1 wherein the tannin concentration of the solution is at least 0.01 wt.%.

3. The process of claim 1 wherein the solution is maintained at a temperature of 100° to 180° F.

4. The process of claim 1 wherein the solution pH value is between 10 and 13.

5. The process of claim 1 wherein the solution additionally contains a surfactant in an amount sufficient to improve the cleaning ability of the solution.

* * * * *